United States Patent [19]

Morgan

[11] 4,248,144

[45] Feb. 3, 1981

[54] CAN CRUSHER HAVING TWO MOVABLE JAWS

[76] Inventor: Kenneth Morgan, 4707 Brooks St., Montclair, Calif. 91763

[21] Appl. No.: 52,451

[22] Filed: Jun. 27, 1979

[51] Int. Cl.[3] ..... B30B 1/30; B30B 9/32

[52] U.S. Cl. ..... 100/244; 100/DIG. 2; 100/257; 100/266; 100/269 R; 100/278; 100/295; 100/270

[58] Field of Search ..... 100/DIG. 2, 266, 218, 100/278, 279, 244, 257, 295, 264, 268, 269 R, 270; 241/99

[56] References Cited

U.S. PATENT DOCUMENTS

| | | | |
|---|---|---|---|
| 883,145 | 3/1908 | McMurray | 100/278 |
| 1,096,051 | 5/1914 | Nabb | 100/244 |
| 2,968,235 | 1/1961 | Marica | 100/DIG. 2 |
| 3,106,888 | 10/1963 | Chapleau | 100/DIG. 2 |
| 3,816,052 | 6/1974 | Schoppee | 100/264 |
| 3,986,921 | 10/1976 | Putnam | 100/264 |

*Primary Examiner*—Billy J. Wilhite

*Attorney, Agent, or Firm*—K. H. Boswell; E. D. O'Brian

[57] ABSTRACT

An improved can crusher has two movable jaws, a first jaw and a second jaw, both movably mounted in a support housing. The jaws are initially spaced apart one from the other a distance sufficient to allow a can to be inserted between them. A member capable of generating a mechanical force is mounted on the housing and is directly connected by a connecting member to the second of the movable jaws by a force transferring member and is indirectly connected by the same connecting member to the first jaw by a force modifying member. The force modifying member modifies the mechanical force so generated to achieve a mechanical advantage. When the member capable of generating the mechanical force is activated this force is first transferred to the first jaw, and because of the mechanical advantage achieved, the first jaw is able to initially overcome the structural resistance of the can and crimp it. After the can is once crimped its structural resistance to crushing is lessened and the second jaw can then finish crushing the can without the need of a mechanical advantage. After the can is completely crushed between the first and second jaw the member capable of generating the mechanical force is relaxed and the jaws move apart from each other allowing the crushed can to be expelled from the housing.

14 Claims, 11 Drawing Figures

CAN CRUSHER HAVING TWO MOVABLE JAWS

CROSS-REFERENCE

None.

BACKGROUND OF THE INVENTION

This invention is directed to a can crusher having two movable jaws reciprocally movably mounted in a housing such that the jaws can move toward one another to crush a can. In response to an applied force the first jaw moves with a mechanical advantage compared to the other which allows the first jaw to initiate crushing the can.

Presently because of the need to conserve resources the recycling of cans, most notably aluminum cans, has been undertaken with the cooperation of a large segment of the population. Several decades ago recycling was not the issue it is today; however, in order to reduce the space cans occupied in home trash cans and the like several types of can crushers were developed.

The known can crushers generally fit into two categories. The first of these categories utilizes an apparatus having a fixed backing plate and one movable jaw which is moved toward the backing plate via a lever and a thrust link. In this type of can crusher a can is inserted between the movable jaw and the backing plate and pressure is applied to the movable jaw by movement of the lever. Since cans are cylinders they have a considerable amount of strength in their cylindrical wall along the axis of the wall which is colinear with the axis of the cylinder. It takes a considerable amount of pressure to initially distort the can along this axis. Once the can is distorted, however, this pressure is not needed. This raises the possibility of injury using these devices because the person using the crusher must initially exert a large force on the lever and after the can is initially crimped this large force may cause the lever and the person pushing on it to suddenly go forward. Additionally, a child or a feeble person may not be able to exert enough pressure on the lever to initially crush the can.

A second type of can crusher utilizes a blade which initially shears off the top and/or bottom of the can. This blade is sharp and after shearing, sharp edges are formed on the pieces of the can that remain. These sharp pieces are capable of cutting the person handling them and thus extreme caution must be used in using this device. Further, if a person inadvertently placed a body member into the device and the device is activated the sharp edge is capable of puncturing or severing the body member.

SUMMARY OF THE INVENTION

In view of the above it is considered that there exists a need for a new type of can crusher which is safe to use, which can be used by a small child or a weak or feeble person, and which can be used in a rapid manner allowing the crushing of a large number of cans by an individual to be done in an expedient manner. It is therefore a broad object of this invention to fulfill the above needs. It is a further object to provide a device which is simple in construction and thus can be manufactured relatively inexpensively allowing it to be readily available to a large number of people who are interested in ecology and recycling.

These and other objects which will become evident from the remainder of this specification are achieved by providing a can crusher having a support housing in which two jaws are movably mounted. Attaching to the support housing is a member capable of generating a mechanical force upon being activated. This member is linked to the first of said jaws via a mechanism which will modify the mechanical force generated by the member to achieve a mechanical advantage. The member is also linked to the second of these jaws in a direct manner not utilizing a modification of the force. A can to be crushed is placed between the two jaws and the member capable of generating a mechanical force is actuated. This force is transferred first to the first jaw which modifies the force in a manner creating a mechanical advantage to increase the force. This enables movement of the first jaw to initially crimp or slightly crush the can. The force from the member capable of generating a force is then transferred to the second jaw which although it does not move with the mechanical advantage of the first jaw, it moves with a force sufficient to complete crushing of the can. Further, the second jaw moves more rapidly than the first jaw; thus, the can is first easily crushed by the first jaw and secondly crushing is rapidly completed by the second jaw.

In the preferred embodiment of the invention a lever is used to generate the mechanical force and a cable is used to transmit it. A pulley is mounted to the first jaw which incorporates the movement of the cable and achieves a mechanical advantage by moving only one-half the distance that the cable is moving in exchange for doubling the force. The cable is directly hooked to the second jaw and the second jaw moves in a one-to-one response to the cable. The jaws are mounted in the housing within a track which guides them in correct alignment with respect to one another and with the can being crushed. The track includes a stop for the first jaw. After the first jaw has moved a pre-set increment of distance it abuts against the stop and all further motion of the cable is transferred only to the second jaw. The housing can include a void space underneath the jaws which allows a crushed can to drop freely from the jaws facilitating removal of the can from the can crusher.

While the preferred embodiment incorporates the use of a lever and a cable to move the jaws, other mechanisms including a master cylinder and two slave cylinders can be used for moving the jaws. If a master cylinder and two slave cylinders are used the surface areas of the two slave cylinders can be different allowing one of them to have a greater mechanical advantage compared to the other.

BRIEF DESCRIPTION OF THE DRAWINGS

This invention will be better understood when taken in conjunction with the drawings where, ı.

Figure 1:
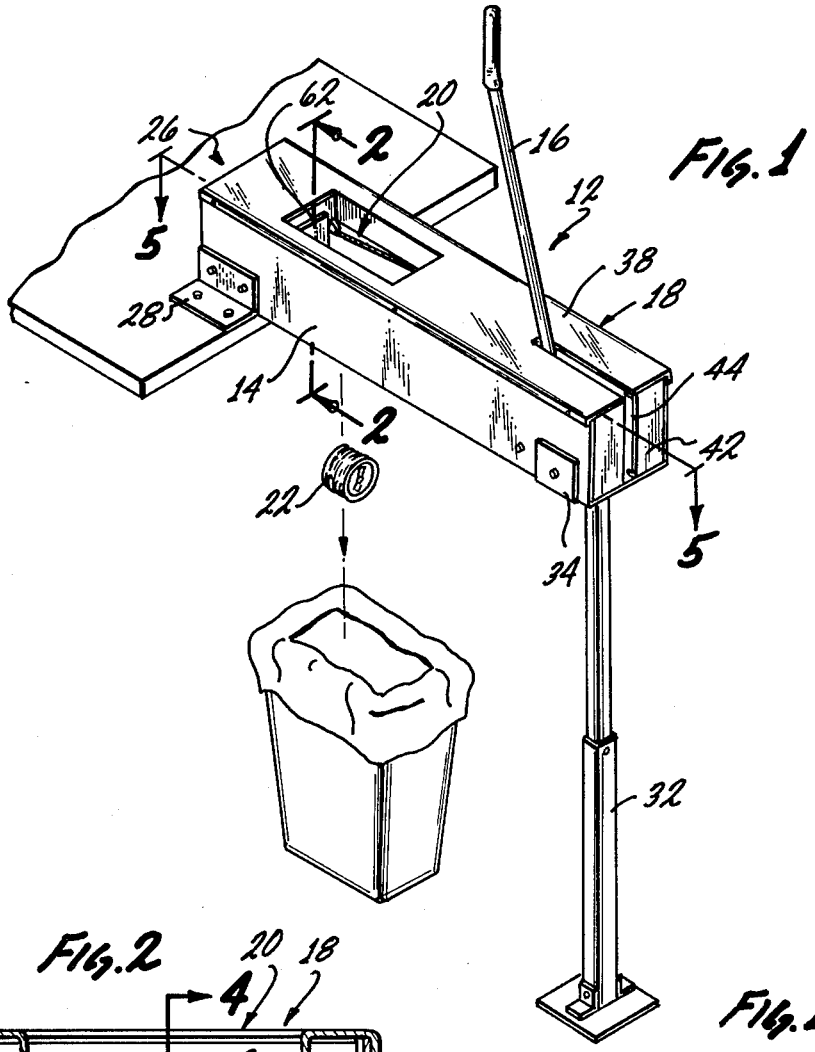
FIG. 1 is an isometric view of the preferred embodiment of the invention.
Figure 2:
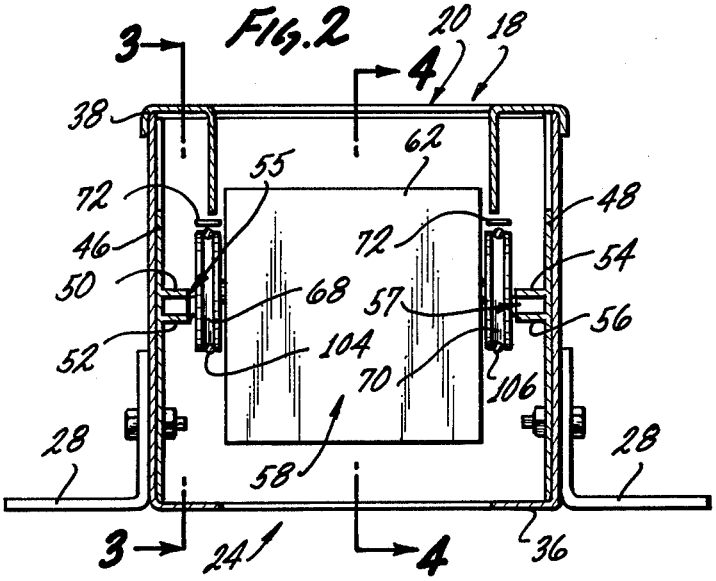
FIG. 2 is an end elevational view in section about the line 2—2 of FIG. 1.
Figure 10:
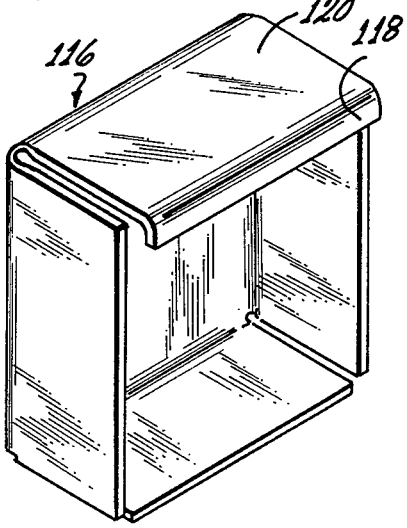
FIG. 10 is an isometric view of an insert to be used with the preferred embodiment of the invention to adapt the invention to accommodate different sized cans.

The invention shown in the drawings and described in this specification utilizes certain principles and concepts as are set forth in the appended claims. Those skilled in the mechanical arts will realize that these concepts and principles could be used in a number of differently appearing and differently describable embodiments. For this reason this invention is to be construed in light of the claims appended to this specification and is not to be construed as being limited to the exact embodiment shown in the drawings and described in the specification.

DETAILED DESCRIPTION

The can crusher 12 shown in FIG. 1 includes a housing 14 having a lever 16 extending from its upper surface 18. Also found in the upper surface 18 is an insert hole 20 through which a can to be crushed is inserted into the housing 14. For the purposes of this specification the numeral 22 will be used to generally identify a can, interchangeably, no matter what state the can is in, i.e., whether it is whole or crushed, or an intermediate state thereof. Located in the bottom of housing 14 is a discharge hole 24 which allows the can 22 to fall from the housing into a suitable receptable such as the basket (not numbered) shown in FIG. 1.

The housing 14 can be mounted in a multiplicity of ways. The preferred type mounting is that shown in FIG. 1. The end 26 of the housing 14 is suitably supported on a surface (not separately numbered) by two L brackets both identified by the numeral 28 which are bolted onto the housing 14 and can either rest on a surface or be bolted thereon. Proximal to the other end 30 of the housing 14 is an extendable leg 32 which is appropriately mounted to a bracket 34 on the bottom of the housing 14. The leg 32 can be a telescopic type leg as shown which is adjustable to allow the can crusher 12 to be positioned at a variety of different heights on a variety of different support surfaces.

The housing 14 is composed of a main U shaped section 36 forming the bottom and both sides of the housing 14. Mounted to the U shaped section 36 is a top section 38 and two end sections 40 and 42. End section 40 is a flat member which seals up the end 26 of housing 14. End section 42 is a composite member formed of two halves (not separately numbered) such that a space or channel 44 is formed in the end section 42. This channel 44 extends partly through top section 38 providing a space allowing lever 16 to move through both the top section 38 and the end section 42.

Mounted within the U shaped section 36 on either side thereof, respectively, is a left-side track member 46 and a right-side track member 48. Normally these track members 46 and 48 would be spot-welded to the interior of the U shaped section 36. However, alternate methods of attachment such as by screws or bolts could also be used. Integrally formed on the left-side track member 46 are two elongated flanges 50 and 52 running along the longitudinal axis of the can crusher 12. Together the flanges 50 and 52 form left-side track 55. Similarly right-side member 48 has identical flanges 54 and 56 forming right-side track 57.

Slidably mounted between the flanges 50 through 56 in tracks 55 and 57 is a first jaw 58 and a second jaw 60. First jaw 58 is mounted proximal to end 26 of housing 14 while second jaw 60 is mounted proximal to lever 16. First jaw 58 is composed of a jaw plate 62 which is suitably attached, e.g., welded, to a T shaped member 64. The edges of T shaped member 64 fit in tracks 55 and 57 between the flanges 50 through 56. The jaw plate 62 is narrower than the T shaped member 64 allowing the jaw plate 62 to freely traverse back and forth within the interior of the housing 14. Mounted behind jaw plate 62 to the surface of T shaped member 64 is an axle 66 having two pulleys 68 and 70, respectively, rotatably mounted on the ends thereof. Mounted on T shaped member 64 and projecting up over the surface of the pulleys 68 and 70 are two cable retention members both collectively identified by the numeral 72. A return spring 74 is attached to the T shaped member 64 and to end section 40 such that it biases T shaped member 64 toward the end 26 of housing 14.

Second jaw 60 is constructed similar to first jaw 58 in that it has a jaw plate 76 and a T shaped member 78. T shaped member 78 is appropriately slidably mounted in tracks 55 and 57 between flanges 50 through 56 and the jaw plate 76 is of a smaller dimension than the T shaped member 78 allowing the second jaw 60 to also freely slide back and forth within the housing 14. The first and second jaws 58 and 60 are located with respect to one another such that their jaw plates 62 and 76 face one another. Located within the elongated flanges 50 through 56 are two second jaw stops collectively identified by the numeral 80. A spring 82 having one end attached to T shaped member 78 and the other end attached as hereinafter described urges second jaw 60 toward end 30 of housing 14 until the T shaped member 78 abuts against the stops 80.

Figure 3:
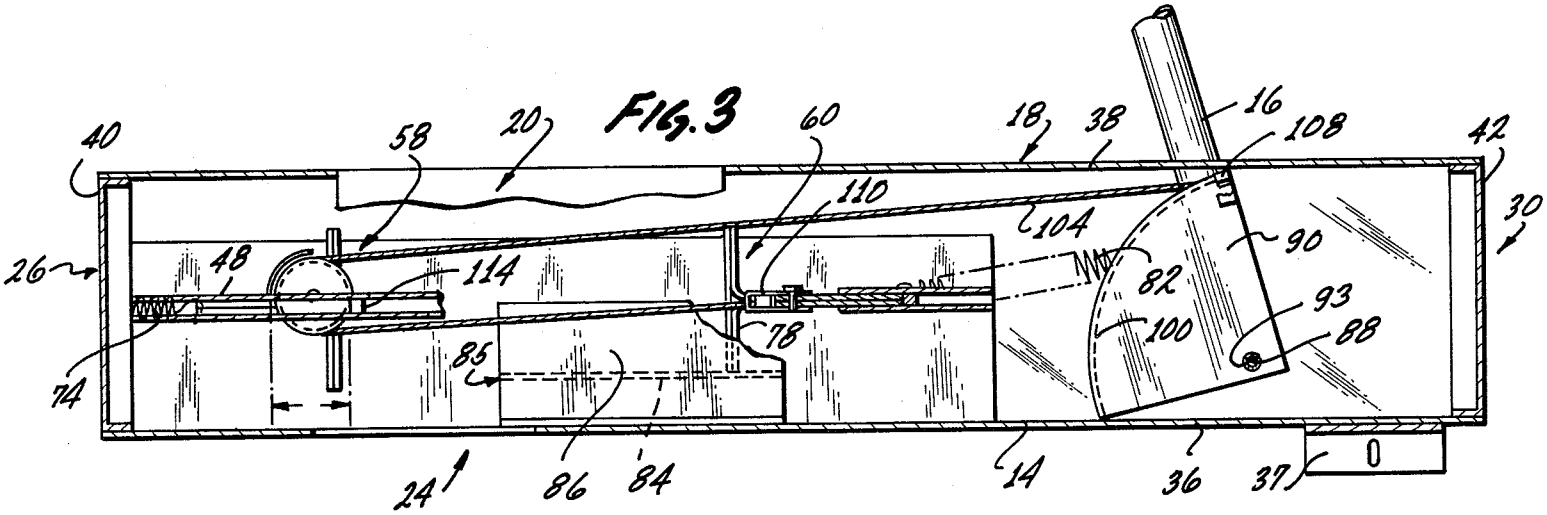
FIG. 3 is a side elevational view in partial section about the line 3—3 of FIG. 2.
Figure 4:
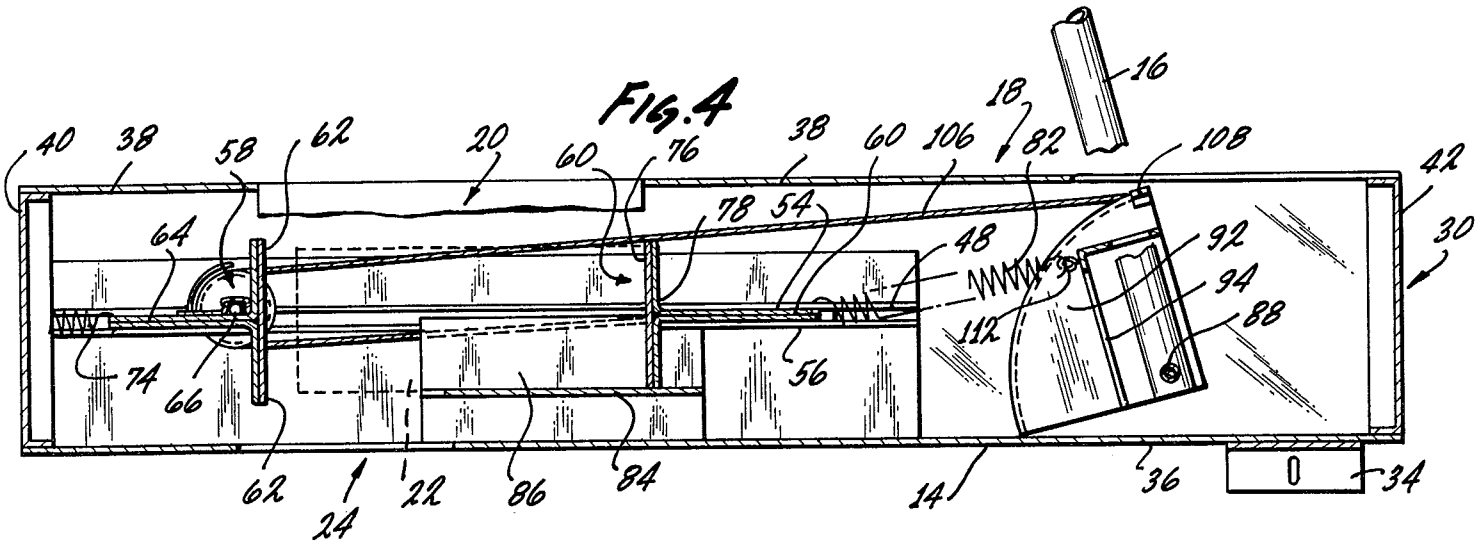
FIG. 4 is a side elevational view in partial section about the line 4—4 of FIG. 2.
Figure 5:
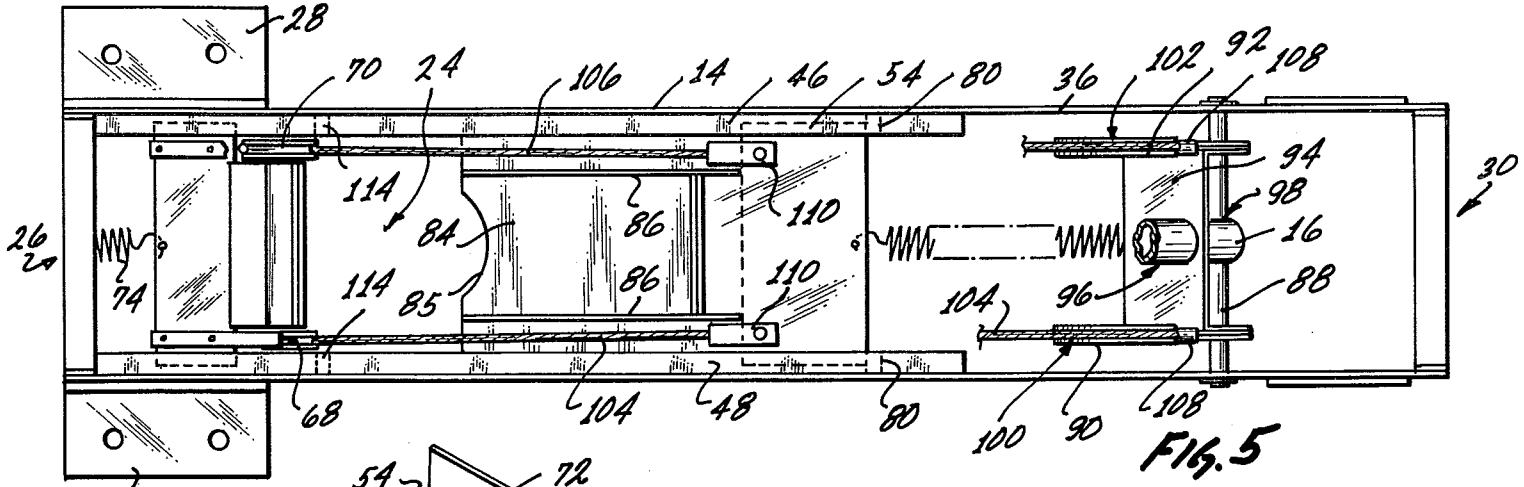
FIG. 5 is a top elevational view about the line 5—5 of FIG. 1 showing a top plan view of certain of the internal components of the invention.
Figure 6:
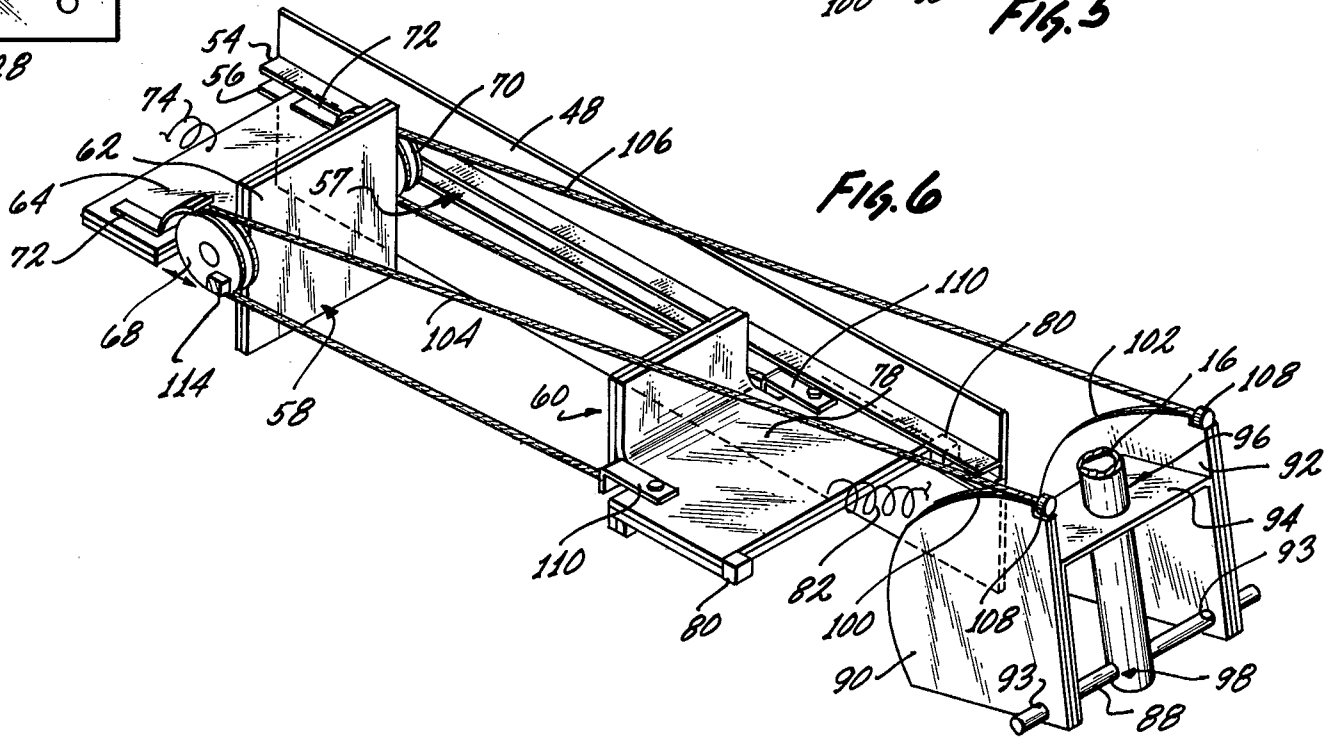
FIG. 6 is an isometric view of the internal working components of the invention, the housing having been removed to better expose these working components.

A can retention plate 84 is appropriately mounted within the interior of housing 14 below second jaw 60. The can retention plate 84 does not totally extend across the space between the first and second jaws 58 and 60 but stops in a position in which its edge 85 approximately corresponds to discharge hole 24. When a can 22 is completely crushed as hereinafter explained jaw plate 76 is located proximal to edge 85 of retention plate 84. This in combination with edge 85 having a partially concave shape allows a crumpled can 22 to descend past the edge 85 of can retention plate 84 down through discharge hole 24. Located on each side of can retention plate 84 are two can positioning spacers collectively identified by the numeral 86. These spacers 86 project upwardly for a distance which equals about half the heighth of jaw plate 76 and as best seen in FIGS. 3 and 4 jaw plate 76 slides within the spacers 86. The can positioning spacers 86 thus serve to position a can directly between the jaw plates 62 and 76.

An axle 88 traverses between the upright portions of U shaped section 36 near end 30. Two quarter-round sections 90 and 92 contain suitable bearing surfaces collectively identified by the numeral 93 allowing them to be mounted on and freely pivot about axle 88. An bracket 94 is mounted between the quarter-round sections 90 and 92 and serves to fixedly retain them in position with respect to one another. Bracket 94 contains a hole 96 which accepts lever 16. Lever 16 is appropriately mounted on axle 88 via bearing surfaces collectively enumerated by the numeral 98. Because lever 16 passes through bracket 94 movement of lever 16 about axle 88 is transferred to quarter-round sections 90 and 92. Extending along the arcuate surface of quarter-round sections 90 and 92 are cable guide grooves 100 and 102, respectively.

Two cables 104 and 106 are fixedly attached to quarter-round sections 90 and 92, respectively, via cable retention members collectively identified by the numeral 108. The cables 104 and 106 pass over pulleys 68 and 70 and are fixedly held to the second jaw 60 by two cable holding brackets collectively identified by the numeral 110 suitably attach to T shaped member 78. Spring 82 previously noted as having one end attached to second jaw 60 has the other end hooked to an eye bolt 112 attaching to L bracket 94. The spring 82 thus pulls second jaw 60 toward bracket 94 while at the same time (as viewed in FIGS. 3 and 4) causes both the quarter-round sections 90 and 92 and the lever 16 to rotate counter-clockwise.

When lever 16 is rotated in a clockwise direction this rotation is transferred to quarter-round sections 90 and 92 causing them to rotate in a clockwise direction. As they rotate cables 104 and 106 are stretched and lay into the cable guide grooves 100 and 102 maintaining the cables 104 and 106 onto the surfaces of quarter-round sections 90 and 92. As cables 104 and 106 are stretched they pull the first jaw 58 and the second jaw 60 toward one another. Since cables 104 and 106 pass around pulleys 68 and 70, the force thus exerted to first jaw 58 is amplified by the interaction of the pulleys 68 and 70 with the cables 104 and 106. Any movement of first jaw 58 is modified by this interaction. Assuming that the ends of cables 104 and 106 attached to second jaw 60 are fixed, linear movement of the end of cables 104 and 106 attaching to quarter-round sections 90 and 92 will be twice that in respect to distance of the linear movement imparted to first jaw 58. However, the force of first jaw 58 will be twice that of the force on cables 104 and 106 neglecting friction, of course.

The movement of second jaw 60 is in direct relationship to the movement of cables 104 and 106 since it is directly attached to those cables. Thus, for any increment distance that the ends of cables 104 and 106 attached to quarter-round sections 90 and 92 move, the second jaw 60 will move the same increment distance.

The movement of first jaw 58 by cables 104 and 106 within tracks 55 and 57 is limited by two first jaw stops 114 placed in between the flanges 50 through 56. When the first and second jaws 58 and 60 are in an initial or starting position as depicted in FIGS. 3 and 4, a can 22 can be placed through insert hole 20 between the jaws 58 and 60 and on top of can retention plate 84. A can 22 so placed is shown in phantom in FIG. 4.

Figure 7:
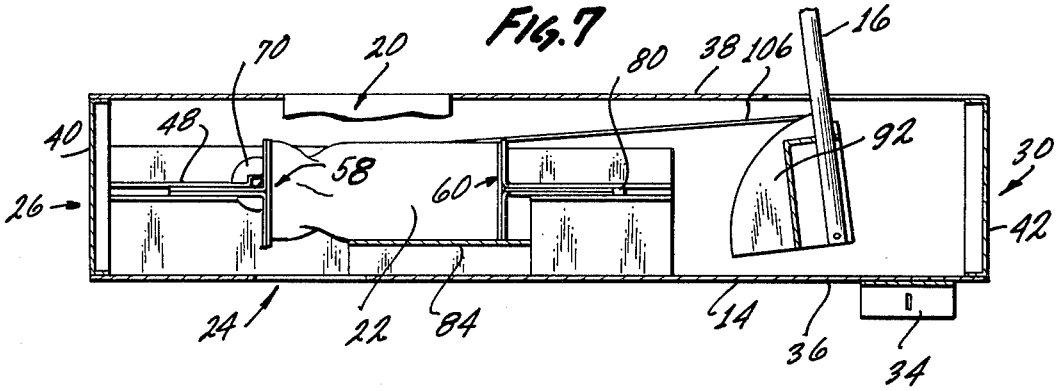
FIGS. 7, 8 and 9 are views similar to FIG. 4 with the exception that they progressively show the sequence of a can as it is crushed by the invention.
Figure 8:
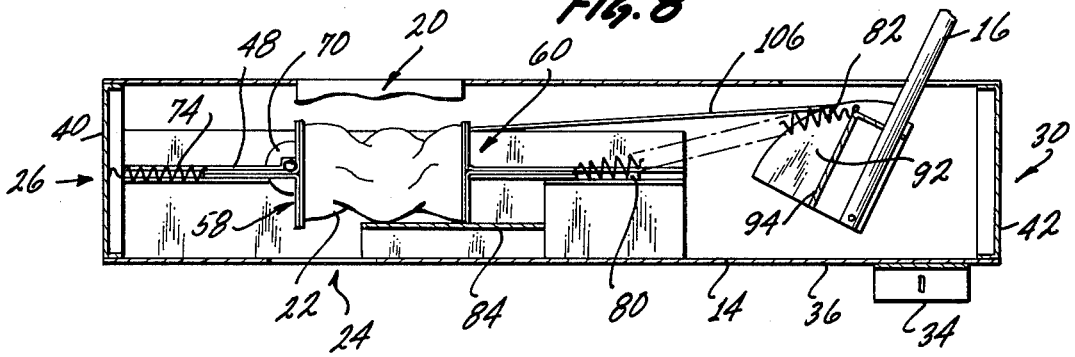
Figure 9:
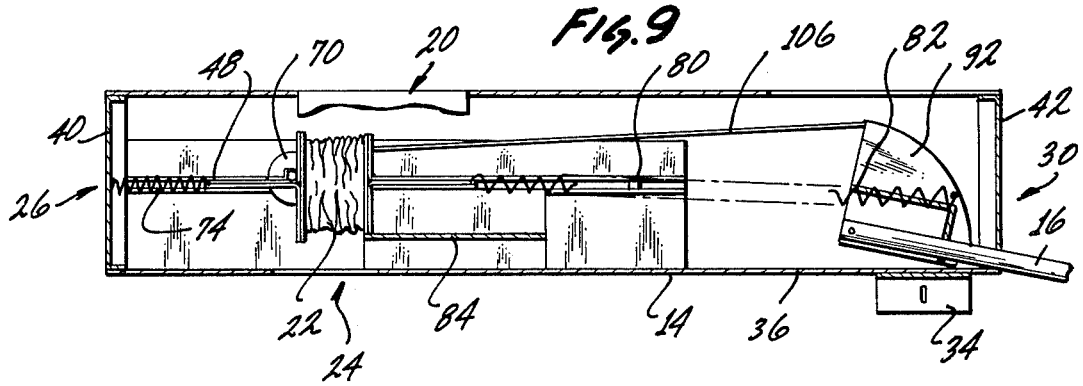

Referring now to FIGS. 7, 8, and 9, after a can 22 is placed within the can crusher 12 as described and jaws 58 and 60 are in their initial positions lever 16 is pulled in a clockwise direction. Since both first and second jaws 58 and 60 are free to move they will do so until they meet with the ends of the can 22 and their travel is inhibited by the physical presence of can 22. At this time second jaw 60 stops and for a limited time can be assumed to be fixedly held. Because of the mechanical advantage achieved via pulleys 68 and 70 attaching to first jaw 58 further movement of the lever 16 will be transmitted to first jaw 58 urging it toward second jaw 60. Theoretically this movement will be at double the force but at one-half the speed of the movement of the ends of cables 104 and 106 attached to quarter-round sections 90 and 92. After sufficient force is exerted against the can 22 by the first jaw 58 the can 22 will begin to crumple or crimp as shown in FIG. 7. This initial crumpling or crimping requires the greatest force in that it must overcome the inherent stability of the cylindrical walls of the cans. However, once these cylindrical walls have been distorted, further distortion of the can 22 is much easier. After the first jaw 58 has traveled the distance necessary to initiate this crumpling or distortion of the can 22 it meets with and is fixedly held by stop 114. Since first jaw 58 can no longer move, further movement of lever 16 is now directly transmitted by the cables 104 and 106 to the second jaw 60. This is depicted in FIG. 8. At the point where lever 16 has been fully rotated approximately 100 degrees clockwise, jaws 58 and 60 will be in what could be described as a second or "crushed" position and the can 22 will be completely crushed as shown in FIG. 9. At this time can 22 will be pushed free of can retention plate 84 and will be fixedly held over discharge hole 24 between jaws 58 and 60.

When the force exerted against lever 16 is released spring 74 will bias first jaw 58 toward the left and spring 82 will bias second jaw 60 toward the right while at the same time biasing lever 16 back to its original position. The crumpled can 22 is then freed from in between jaw plates 62 and 76 and can descend by gravity out of the housing 14 through the discharge hole 24.

The vast majority of beverage cans presently on the market are either of a 12 or 16 ounce size. The distance between the first and second jaws 58 and 60 when they are completely pulled toward end 26 and end 30, respectively, under the bias of springs 72 and 84, respectively, is such that a 16 ounce can will fit between these two jaws 58 and 60. If 12 ounce cans are to be crushed a spacer unit 116 is inserted through insert hole 20 and attached to second jaw 60. The spacer unit 116 in its simplest and preferred form is simply an open sided box having a lip 118 extending from its top surface 120. The lip 118 fits over the top of second jaw 60 fixedly holding the spacer unit 116 against jaw plate 76. The spacer unit 116 is dimensioned to correctly account for the differences between the longitudinal size of the 16 ounce can opposed to the 12 ounce can.

In addition to a 12 ounce spacer unit other spacer units could be used such that smaller cans such as 9 and 6 ounce cans could also be crushed. Cable retention members 72 ensure that cables 104 and 106 do not flip off the pulleys 68 and 70 when jaws 58 and 60 return from the "crushed" position to their initial position.

Figure 11:
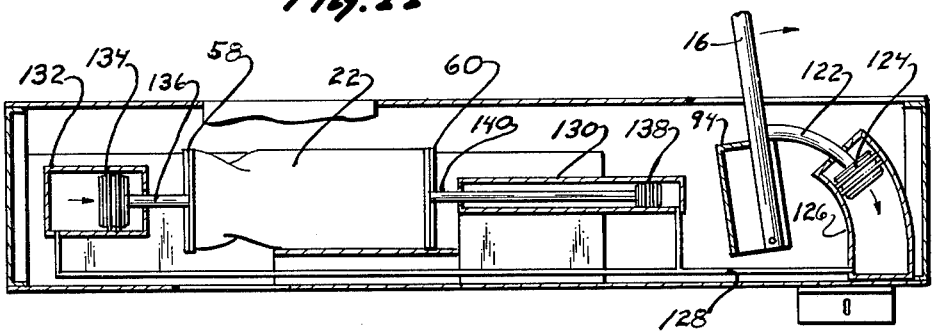
FIG. 11 is a side elevational view in partial section of an alternate embodiment of the invention.

FIG. 11 describes the embodiment noted above wherein a master cylinder and two slave cylinders are substituted for the cable and the pulley. Except for this substitution this embodiment is like the previous embodiment.

In FIG. 11, the lever 16 is attached to a piston rod 122 which in turn attaches to a piston 124 located within master cylinder 126. Leading from master cylinder 126 is hydraulic line 128 which branches to slave cylinder 130 and slave cylinder 132. A piston 134 is located in slave cylinder 132 and connects to jaw 58 via piston rod 136. A piston 138 is located in slave cylinder 130 and connects to second jaw 60 via piston rod 140. The surface area of piston 134 is greater than the surface area of piston 138. When piston 124 moves within master cylinder 126 in direct response to movement of lever 16, hydraulic fluid is forced through the line 128. Since piston 134 has a greater surface area than piston 138 the force generated by piston 124 on the hydraulic fluid is directly transferred to piston 134 initially crumpling the can 22. After jaw 58 travels its limit of travel in a manner analogous to that described for the preferred embodiment above, piston 134 can no longer move and thus all the hydraulic force is transferred to piston 138. Since piston 138 is smaller than either piston 124 or 134 it moves a greater distance, however, with a lesser force. The movement of piston 138 is transferred to second jaw 60 which finishes crumpling the can 22 as per the preferred embodiment.

I claim:

1. A can crusher comprising:

a support housing;

a first movable jaw means and a second movable jaw means both movably mounted in said support housing to move reciprocally between an initial position wherein said first and said second movable jaw means are spaced apart one from the other by a distance at least the length of a can to be crushed and a second position wherein said first and said second movable jaw means are spaced apart one from the other by a distance less than said initial distance so as to enable said first and said second movable jaw means to crush a can placed between said first and said second jaw means when said first and said second jaw means move from said initial position to said second position;

means for generating a mechanical force mounted in said housing and capable of being activated to generate said mechanical force;

a mechanical force transfer means operatively connected to said means for generating a mechanical force so as to transfer said generated mechanical force;

a mechanical force modifying means operatively connected to both said first movable jaw means and said mechanical force transfer means, said mechanical force modifying means modifying said mechanical force transferred to it by said transfer means to achieve a mechanical advantage and transferring said mechanical advantage to said first movable jaw means advantageously moving said first movable jaw means from said initial position;

said second movable jaw means operatively connected to said mechanical force transfer means and moving in response to a mechanical force transferred by said mechanical force transfer means;

said advantageous movement of said first movable jaw means initiating crushing of said can as said first movable jaw means moves toward said second position, said movement of said second movable jaw means crushing said can as said second movable jaw means moves to said second position;

said supporting housing having track means mounted thereon, said first movable jaw means and said second movable jaw means movably mounted in said track means;

said track means including a stopping means positioned in said track means proximal to said first movable jaw means so as to stop the travel of said first movable jaw means in said track means after said can has been initially crushed.

2. The can crusher of claim 1 wherein:

said mechanical force transfer means includes a cable having its ends attaching to said force generating means and said second movable jaw means;

said cable operatively connected to said mechanical force modifying means.

3. The can crusher of claim 2 wherein:

said mechanical force modifying means includes a pulley means operatively connected to said first movable jaw means;

said cable passing through said pulley means intermediate said ends of said cable.

4. The can crusher of claim 3 including a first return means and a second return means, said first return means operatively attaching to said first movable jaw means and capable of moving said first movable jaw means from said second position to said initial position;

said second return means operatively connected to said second movable jaw means and capable of moving said second movable jaw means from said second position to said initial position.

5. The can crusher of claim 4 wherein:

said means for generating a mechanical force includes a lever means pivotally mounted on said support housing;

said cable connecting to said lever means such that when said lever means is pivoted in said support housing the movement of said lever is transferred to said cable.

6. The can crusher which comprises:

a housing;

a first and second movable jaw slidably mounted within said housing to reciprocally move toward and away from each other so as to crush a can between said first and said second jaws as said jaws move toward each other;

a lever rotatably mounted in said housing and including means for transmitting movement attaching to said lever;

at least one cable having one of its ends operatively connected to said means for transferring movement such that movement of said lever is transferred to said cable;

said cable having its other end operatively connected to said second jaw;

a pulley means capable of achieving a mechanical advantage rotatably mounted to said first jaw and including said cable operatively passing over said pulley means intermediate said ends of said cable;

said pulley means moving said first jaw under a mechanical advantage in response to the movement of said cable and said second jaw moving in direct response to movement of said cable.

7. The can crusher of claim 6 wherein:

said pulley means comprises at least one movable pulley rotatably mounted to said first jaw such that a force applied to said pulley by said cable is mechanically transferred to said first jaw.

8. The can crusher of claim 7 wherein:

said means for transmitting movement comprises at least one semicircular member having an arcuate surface operatively attaching to said lever and including said cable attaching to said semicircular member such that as said lever is moved said cable is pulled across the arcuate surface of said semicircular member.

9. The can crusher of claim 8 wherein:

said semicircular member comprises a quarter-round section having a groove along its arcuate surface to receive said cable and to maintain said cable on said arcuate surface.

10. The can crusher of claim 6 including:

a track means mounted in said housing having said first and second jaws slidably mounted in said track means so as to slidably move within said track means.

11. The can crusher of claim 10 wherein:

said track means including a first jaw stopping means capable of limiting the amount of travel of said first jaw in said track means.

12. The can crusher of claim 10 wherein:

said pulley means comprises at least one movable pulley rotatably mounted to said first jaw such that a force applied to said pulley by said cable is mechanically transferred to said first jaw.

13. The can crusher of claim 12 wherein:

said means for transmitting movement comprises at least one semicircular member having an arcuate surface operatively attaching to said lever and including said cable attaching to said semicircular member such that as said lever is moved said cable is pulled across the arcuate surface of said semicircular member.

14. The can crusher of claim 6 including:

a spacer means attaching to one of said first or second jaws reducing the distance between said first and second jaws.

* * * * *